United States Patent [19]

Davidov

[11] Patent Number: 4,578,593

[45] Date of Patent: Mar. 25, 1986

[54] TWO-WAY ELECTRICAL CONTROL MODULE FOR A LAMP OUTLET

[76] Inventor: Mircho A. Davidov, 10337 Rue Finisterre, San Diego, Calif. 92131

[21] Appl. No.: 668,210

[22] Filed: Nov. 5, 1984

[51] Int. Cl.[4] ..... H01H 47/00

[52] U.S. Cl. ..... 307/113; 307/114; 307/115; 307/132 E; 307/140; 361/189; 361/191

[58] Field of Search ..... 307/112, 113, 114, 115, 307/132 R, 132 E, 140; 361/160, 189, 191

[56] References Cited

U.S. PATENT DOCUMENTS

| | | | |
|---|---|---|---|
| 2,979,624 | 4/1961 | Askerneese | 307/112 |
| 3,418,488 | 12/1968 | Platzer, Jr. | 307/114 |
| 3,872,319 | 3/1975 | Platzer, Jr. | 307/114 |
| 4,383,186 | 5/1983 | Liang | 307/113 |

*Primary Examiner*—A. D. Pellinen
*Assistant Examiner*—Derek S. Jennings
*Attorney, Agent, or Firm*—Kinzer, Plyer, Dorn & McEachran

[57] ABSTRACT

An electrical control module to provide both remote and wall-operated switching for an electrical device such as a lamp. The control module includes a receptacle for the lamp plug, a remote on/off switch and a plug for insertion into the outlet connected to the wall on/off switch for the lamp. A power input is provided for the control module either from the wall outlet receptacle or from a separate receptacle. There are first and second relays within the control module which are effective to provide for independent on/off switching of the lamp by either the remote switch or the wall switch.

5 Claims, 3 Drawing Figures

Fig. 1.
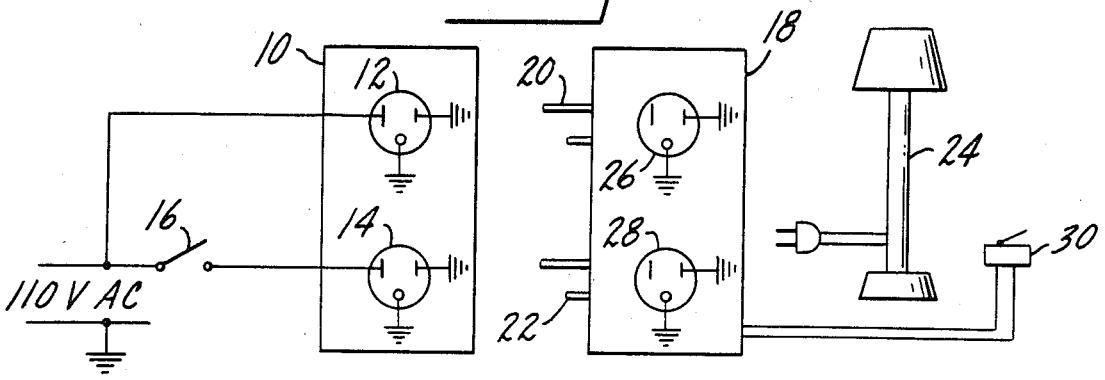
Fig. 2.
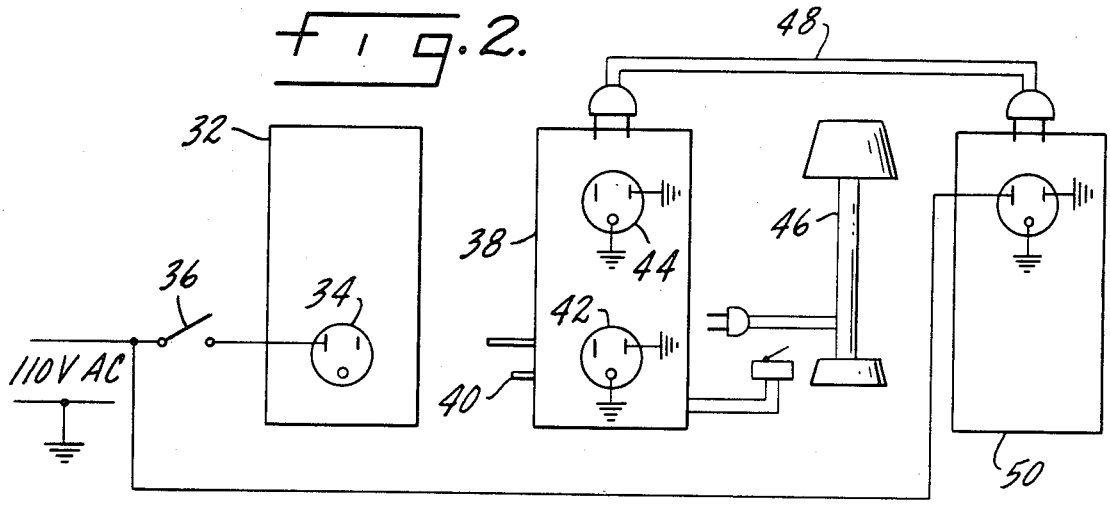
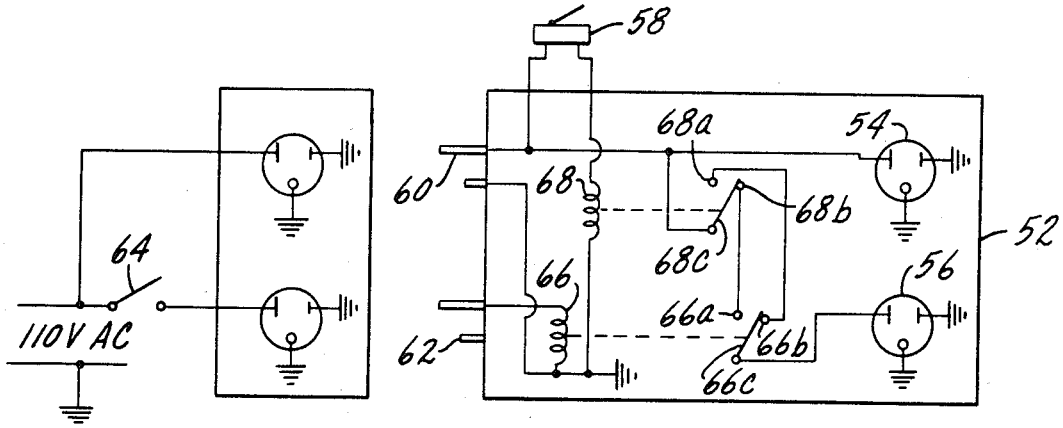
Fig. 3.

TWO-WAY ELECTRICAL CONTROL MODULE FOR A LAMP OUTLET

SUMMARY OF THE INVENTION

The present invention relates to electrical control modules for use in remotely operating electrical devices such as lamps or the like.

A primary purpose of the invention is a simply constructed reliably control module which will permit independent operation of an electrical device such as a lamp from either a remote switch or a wall-operated switch.

Another purpose is a control module of the type described which permits a lamp to be turned on from both a wall switch or a remote switch regardless of the position of the other switch.

Other purposes will appear in the ensuing specification, drawings and claims.

BRIEF DESCRIPTION OF THE DRAWINGS

The invention is illustrated diagrammatically in the following drawings wherein:

FIG. 1 is a diagram of one wiring arrangement using the control module of the present application, FIG. 2 is a diagram of a second wiring arrangement using a modified control module, and FIG. 3 is a wiring diagram of the control module disclosed herein.

DESCRIPTION OF THE PREFERRED EMBODIMENT

Traditionally, it has been possible to independently turn "on" or "off" a lamp from two distant locations, either a wall switch or the lamp site itself, normally a switch on the lamp. This was possible if special wiring and switches were provided for the wall or lamp switches and the outlet for the lamp. However, in many cases a lamp outlet switchable on/off from a distant wall switch only is provided, thus forcing a cumbersome one-way mode of lamp control—once the lamp is switched off from the wall switch, it cannot be subsequently turned on from the lamp site location unless it is turned on first at the wall switch location and vice versa.

More recently, a power line carrier system has been proposed for remotely operating a lamp or other electrical device. This system makes use of carrier modulated signals, transmitted down the power lines from a central location to electronic modules connected to the power line in order to control any device attached to it. However, if a power line carrier system is to control a lamp from both the wall switch or the lamp site locations, modifications of the wall switch or the existing wiring is needed.

The present invention provides two-way electrical control of a lamp or other electrical device. In this connection, the invention should not be limited to the operation of a lamp as there are many other appliances which require operation from remote locations and in which the control module disclosed herein will be similarly usable. The lamp, as described herein, may be operated from a wall switch or from a remote on/off switch. These two switches are independent and each can separately control the lamp or other electrical device.

In FIG. 1, a wall receptacle is indicated at 10 and it has a first or hot outlet 12 and a lamp outlet 14. The lamp outlet 14 is connected through a wall switch 16 to a source of AC power, typically a 110-volt power source. Outlet 12 is also connected to the 110-volt power source, but switch 16 does not control the application of power to outlet 12.

A control module 18, described in connection with FIG. 3, is shown as having a first plug 20 and a second plug 22 which will plug into the outlets 12 and 14 of the receptacle 10. A lamp indicated at 24 will plug into one of the two receptacles 26 and 28 which form a part of control module 18 and the control module will include a remote on/off switch 30 which provides a means for operating the lamp as does wall switch 16.

In the arrangement of FIG. 1, power for the control module is provided from the 110-volt source through outlet 12 and then through plug connection 20 into the control module.

In the modification of FIG. 2, a receptacle 32 has only a single outlet 34 and this outlet is connected through a wall switch 36 to the source of power. A control module 38 has a single plug 40 which can plug into outlet 34. Control module 38 has a first outlet 42 and a second outlet 44. As was the case in the arrangement of FIG. 1, a lamp 46 will have its plug inserted in outlet 42. Outlet 44 is used to provide a power input for the control module and this can be done by an extension cord or the like 48 which is connected from an adjacent outlet 50 to outlet 44. Thus, extension cord 48 provides power from receptacle 50 to outlet 44 in the same manner that power was supplied to the control module of FIG. 1 directly to outlet 12.

In both the FIGS. 1 and 2 arrangements the control module is effective to provide for on/off operation of the associated lamp from either the wall switch or the remote on/off switch. Either one of these switches can independently, and without regard to the position of the other, turn on and off the lamp or another electrical device plugged into the outlet.

FIG. 3 shows the construction of the control module. A housing 52 mounts a first outlet 54 and second outlet 56 with outlet 56 being the lamp outlet and outlet 54 providing a means for power input in the FIG. 2 wiring arrangement. The remote on/off switch is indicated at 58 and the plug connections for the control module are indicated at 60 and 62, respectively. Plug 62 will be connected to the lamp outlet and through the lamp outlet to the wall switch indicated at 64. The control module in FIG. 3 may utilize the wiring arrangement of FIG. 1 and hence there is a second wall outlet to provide the power input to the control module.

Within the control module there is a first relay having a coil 66 connected between the hot and ground sides of plug connection 62. Relay coil 66 has contacts **66*a* and 66*b* and a contact arm 66*c*. Contact arm 66*c* is connected to the hot side of lamp outlet 56. A second relay coil 68 is connected between the ground side of plug connection 62 and one side of remote on/off switch 58, with the other side of switch 58 being connected to the hot or power side of plug connection 60. Relay coil 68 is associated with a contact arm 68*c* and with contacts 68*a* and 68*b*. Contact arm 68*c* is connected to the power side of outlet 54 and to the power side of plug 60. Contact 68*b* is connected to contact 66*a* and contact 68*a* is connected to contact 66*b***.

In operation, if wall switch 64 is closed, power will be supplied from the 110-volt source through plug connection 62 to coil 66. This will cause coil 66 to have its contact arm moved from the position shown to make with contact 66*a* and thus through relay contacts 68*b* and 68*c* to the power side of plug connection 60. Thus, power is provided to lamp outlet 56 from plug connection 60. If wall switch 64 is open, power is taken away from the lamp outlet.

When remote switch 58 is closed, relay coil 68 will receive power and contact arm 68*c* will move from contact 68*b* to contact 68*a*. Thus, power from the power side of plug connection 60 will be provided from contact arm 68*c* to contact 68*a* and then through the contacts of relay 66 to the lamp outlet. Thus, each of the two switches, the wall switch and the remote on/off switch, independently provide power to the lamp outlet from the power input, in this case plug connection 60. If the lamp is turned on from either switch 64 or from switch 58, the lamp may be turned off from the other. If the power input is through an extension cord, as in FIG. 2, the method of operation will be the same, as outlet 54 is directly connected to plug connection 60. Accordingly, there is independent operation of the lamp from either of the two switches without regard to the position of the other.

The control module can also function as a means to remotely control a lamp without the use or need of a wall switch. If the module of FIG. 3 is plugged into a normal two outlet receptacle, the applied power will energize coil 66 and move its contact arm 66*c* to close on contact 66*a* and thus provide power from plug connection 60 to lamp outlet 56. Remote switch 58 will now control the power to the lamp outlet to provide remote control for turn-on or turn-off of the lamp providing the lamp switch is on.

Whereas the preferred form of the invention has been shown and described herein, it should be realized that there may be many modifications, substitutions and alterations thereto.

The embodiments of the invention in which an exclusive property or privilege is claimed are defined as follows:

1. An electrical control module adapted to be connected to a wall-type receptacle to provide remote on/off switching of an electrical device such as a lamp or the like, and in which a wall-type on/off switch for the device is separately connected to the wall receptacle, said module including a housing, at least one receptacle outlet in the housing and adapted to receive a plug from the electrical device, a plug connection extending from the housing and adapted for insertion in the wall-type receptacle and connection to the wall-type on/off switch, means for providing a power line input to the housing, a remote on/off switch connected to the housing, and relay means positioned within the housing and connected between the plug connection, the power line input, the receptacle outlet and the remote on/off switch, said relay means including a first relay and a second relay, with each relay including a coil, with power to the first relay coil being controlled by the wall-type on/off switch and with power to the second relay coil being controlled by the remote on/off switch, whereby power is supplied to or removed from said receptacle outlet by independently operating either said remote on/off switch or the wall-type on/off switch.

2. The electrical control module of claim 1 further characterized by and including a second plug connection extending from the housing for insertion in the wall-type receptacle, which second plug connection provides the power line input.

3. The electrical control module of claim 1 further characterized by and including a second receptacle outlet in the housing and means for connecting said second receptacle outlet to a power source to provide the power line input.

4. The electrical control module of claim 1 further characterized in that said first and second relays each include contacts, with the application of power from the power line input to the receptacle outlet being controlled by both the contacts of said first and second relays.

5. An electrical control module adapted to be connected to a two outlet receptacle to provide remote on/off switching of an electrical device such as a lamp or the like, said module including a housing, at least one receptacle outlet in the housing and adapted to receive a plug from the electrical device, plug connections extending from the housing and adapted for insertion in the receptacle outlets to provide power line input to both housing plug connections, a remote on/off switch connected to one of said plug connections, the other plug connection being connected to said housing receptacle outlet, and relay means positioned within the housing and connected between said plug connections, said housing receptacle outlet and the remote on/off switch, said relay means including a first relay and a second relay, with each relay including a coil, with power to one of said relay coils being controlled by the remote on/off switch, whereby said switch controls the application of power from said one plug connection to said housing receptacle outlet.

* * * * *